US008235261B1

(12) United States Patent
Park et al.

(10) Patent No.: US 8,235,261 B1
(45) Date of Patent: Aug. 7, 2012

(54) FOLDABLE COAT HANGER

(75) Inventors: Hong Jae Park, Gyeonggi-do (KR); Seung Hwan Kim, Gyeonggi-do (KR)

(73) Assignee: T&P Co., Ltd. (KR)

( * ) Notice: Subject to any disclaimer, the term of this patent is extended or adjusted under 35 U.S.C. 154(b) by 0 days.

(21) Appl. No.: 13/176,769

(22) Filed: Jul. 6, 2011

(51) Int. Cl.
*A41D 27/22* (2006.01)

(52) U.S. Cl. ..... 223/94

(58) Field of Classification Search ..... 223/85, 223/88–90, 92, 94
See application file for complete search history.

(56) References Cited

U.S. PATENT DOCUMENTS 5,511,701 A * 4/1996 Lam ..... 223/85
6,644,520 B2 * 11/2003 Lam ..... 223/94
7,237,702 B2 * 7/2007 Landis et al. ..... 223/89
2006/0054646 A1 * 3/2006 Nathanmanna ..... 223/89
2011/0284597 A1 * 11/2011 Kaleta et al. ..... 223/85

FOREIGN PATENT DOCUMENTS

DE 19860605 A1 * 7/2000
JP 2004261416 A * 9/2004

* cited by examiner

*Primary Examiner* — Nathan Durham
(74) *Attorney, Agent, or Firm* — Galbreath Law Offices, P.C.; John A. Galbreath

(57) ABSTRACT

A foldable coat hanger, which is constructed to be easily folded and unfolded as desired, so that the volume thereof can be reduced as desired and the space-related problem occurring in the use of the conventional hangers can be solved. Further, the size of the coat hanger can be stepwisely adjusted between a plurality of size stages, so that the size of the coat hanger can be appropriately adjusted according to the size of a garment, thus efficiently fitting garments having different sizes and efficiently hanging and protecting the garments.

5 Claims, 7 Drawing Sheets

FOLDABLE COAT HANGER

BACKGROUND OF THE INVENTION

1. Field of the Invention

The present invention relates, in general, to coat hangers and, more particularly, to a foldable coat hanger configured to be folded and unfolded as desired.

2. Description of the Related Art

Generally, a conventional coat hanger includes a shoulder-shaped frame for hanging a garment on when the garment is not in use, with a hook provided at the top of the frame to allow hanging on a hanging member, such as a hanging hook or a hanging rod, installed in a wardrobe, etc. When using the coat hanger, a garment is draped on the frame and is hung on a hanging member by the hook. However, the above-mentioned conventional coat hangers are problematic in that they have been designed to have the same width regardless of the size of garments to be hung on the hangers, so that the size of the hangers may not be appropriate for the size of the garment, thereby not allowing the garments to be efficiently hung. Further, conventional coat hangers may occupy an excessive amount of space in the wardrobe, thereby reducing space-related efficiency of the wardrobe.

SUMMARY OF THE INVENTION

Accordingly, the present invention has been made keeping in mind the above problems occurring in the related art, and the present invention is intended to propose a foldable coat hanger, which is configured to be folded and unfolded as desired, so that the volume thereof can be reduced as desired and efficiently fitting garments having different sizes and solving the space-related problem occurring in the use of conventional coat hangers.

In order to achieve the above object, according to one aspect of the present invention, there is provided a foldable coat hanger including a hook unit having a hook in an upper part thereof; a housing unit with which the hook unit is assembled such that the hook unit can be moved upwards or downwards vertically; and a pair of hanging arms rotatably assembled with opposite sides of the housing unit, wherein the hook unit includes: a control gear connected to a lower end of the hook and extending in an axial direction, with a plurality of teeth formed along a side edge of the control gear in the axial direction; a rack gear connected to a lower end of the control gear and extending in the axial direction, with a plurality of teeth formed along each of opposite side edges of the rack gear in the axial directions; and an actuating unit removably caught by one of the teeth of the control gear and stopping a position of the control gear, the housing unit includes: two first pinion gears symmetrically provided in the housing unit at locations in opposite sides of the rack gear and rotatably engaging with the teeth formed along the opposite side edges of the rack gear, and the two hanging arms are rotatably fitted over respective bearing shafts provided at opposite locations inside the housing unit and extend outwards from the housing unit while being bent toward each other, with second pinion gears formed around respective ends of the two hanging arms fitted over the bearing shafts and rotatably engaging with the respective first pinion gears.

As described above, the foldable coat hanger according to the present invention is advantageous in that the foldable coat hanger can be easily folded and unfolded as desired, so that the volume thereof can be reduced as desired and it can be fit garments having different sizes, and solving the space-related problem occurring in the use of the conventional hangers. In addition, the foldable coat hanger according to the present invention is advantageous in that users can easily fold the foldable coat hanger at a clip by pushing a switch (an actuating unit) and unfold the foldable coat hanger by putting two hanging arms apart at the width of a garment to be hanged.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
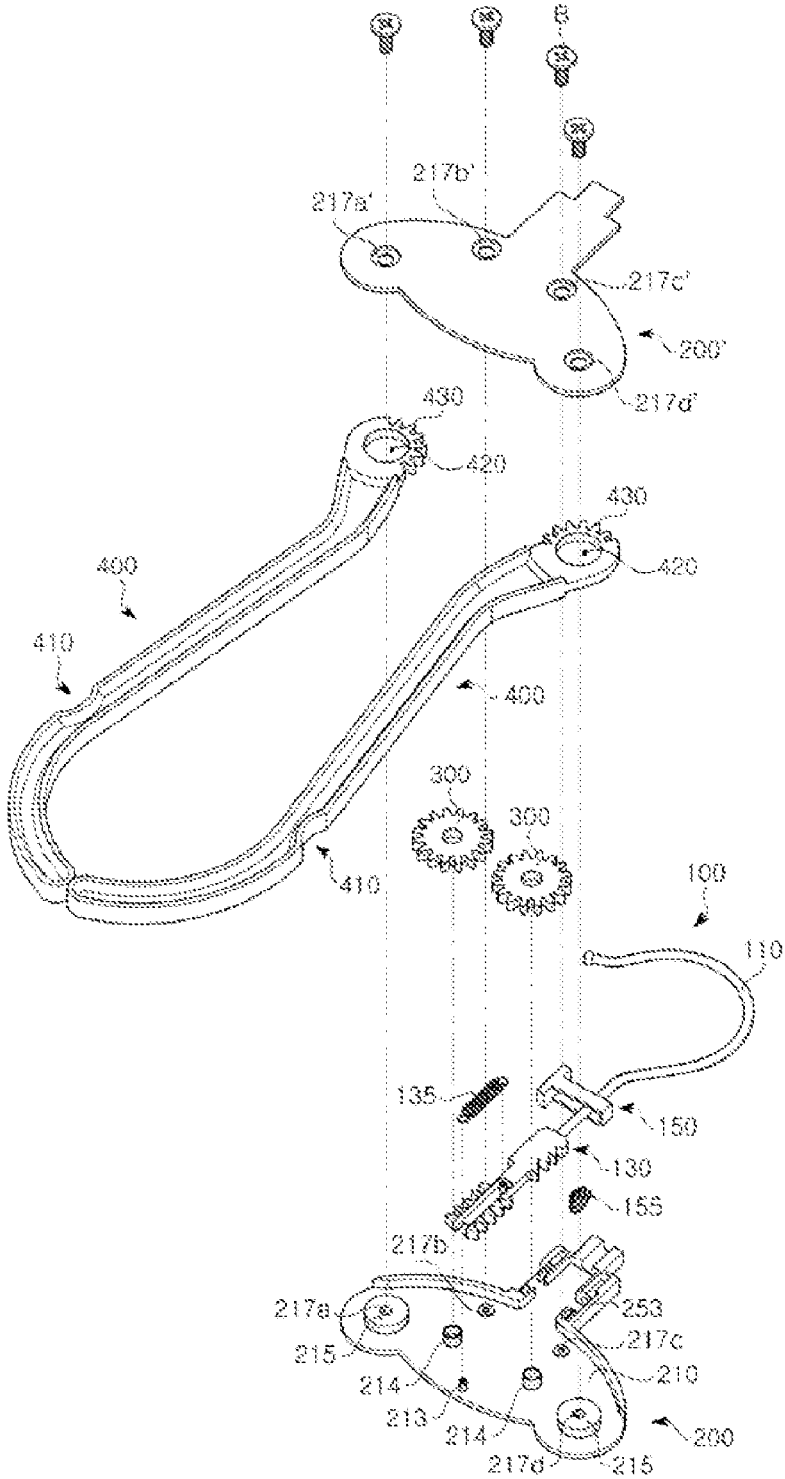
FIG. 1 is an exploded perspective view of a foldable coat hanger according to an exemplary embodiment of the present invention.

The invention will now be described more fully hereinafter with reference to the accompanying drawings, in which exemplary embodiments of the invention are shown. The present invention may, however, be embodied in many different forms and should not be construed as being limited to the embodiments set forth herein. Rather, these embodiments are provided so that this disclosure will be thorough and complete, and will fully convey the scope of the invention to those skilled in the art. The same reference numerals refer to similar elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the nature of the present invention.

The terminology used herein is for the purpose of describing particular embodiments only and is not intended to limit the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass the orientations of both above and below.

Unless otherwise defined, the meaning of all terms including technical and scientific terms used herein is the same as that commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross-section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as being limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, exemplary embodiments of the present invention will be described in further detail with reference to the accompanying drawings.

Figure 2:
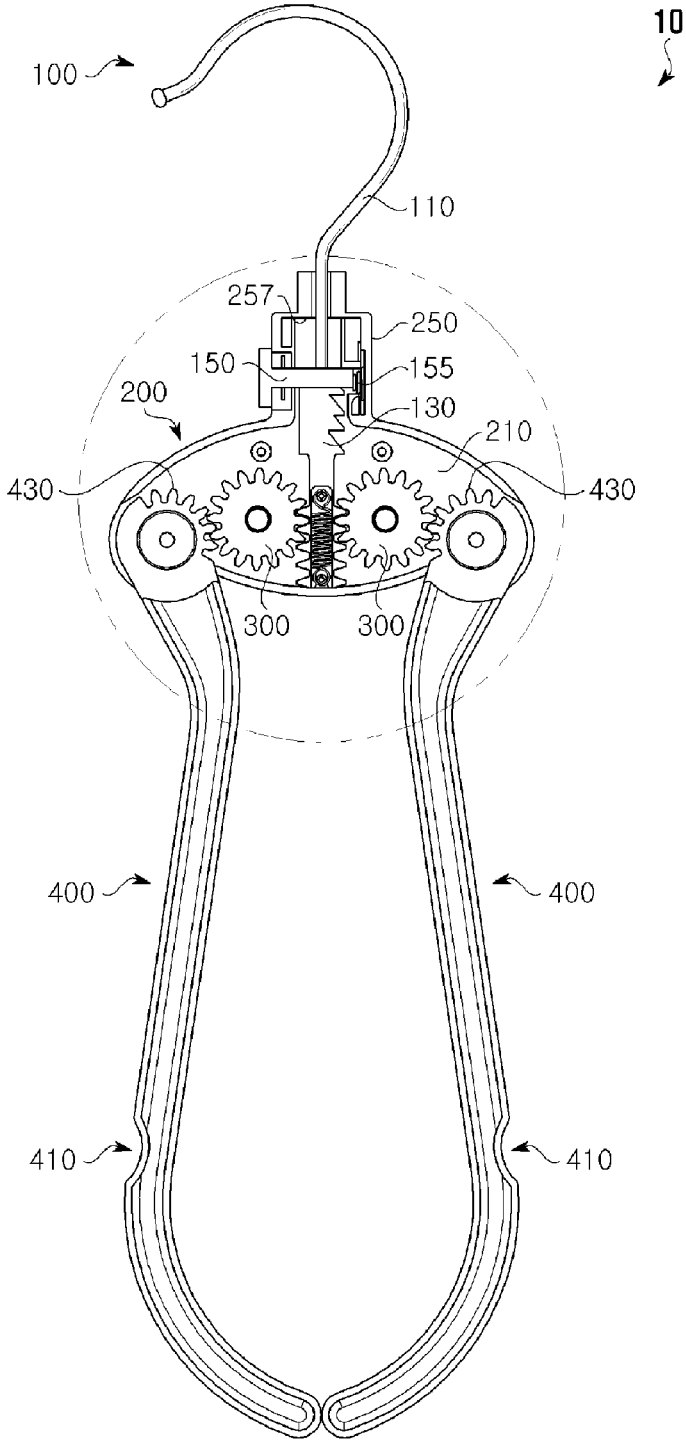
FIG. 2 is a plan view illustrating the construction of the foldable coat hanger according to the exemplary embodiment of the present invention.
Figure 3:
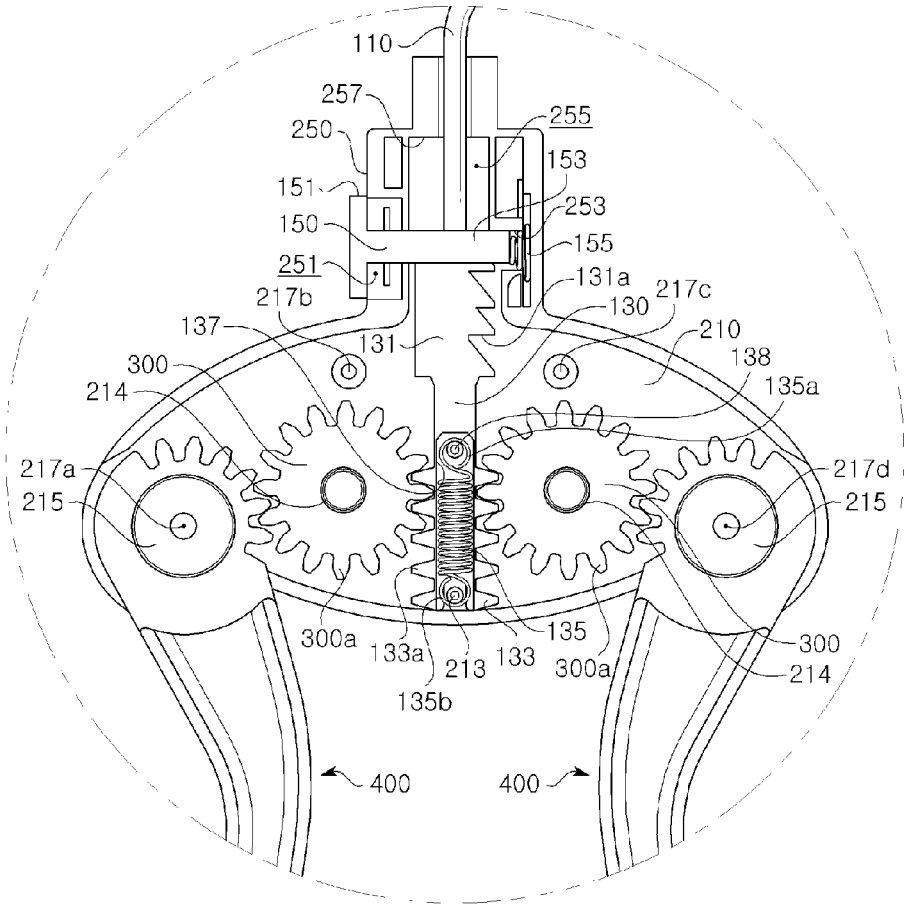
FIG. 3 is an enlarged plan view illustrating the interior construction of the foldable coat hanger fabricated inside the dotted circle of FIG. 1.
Figure 4:
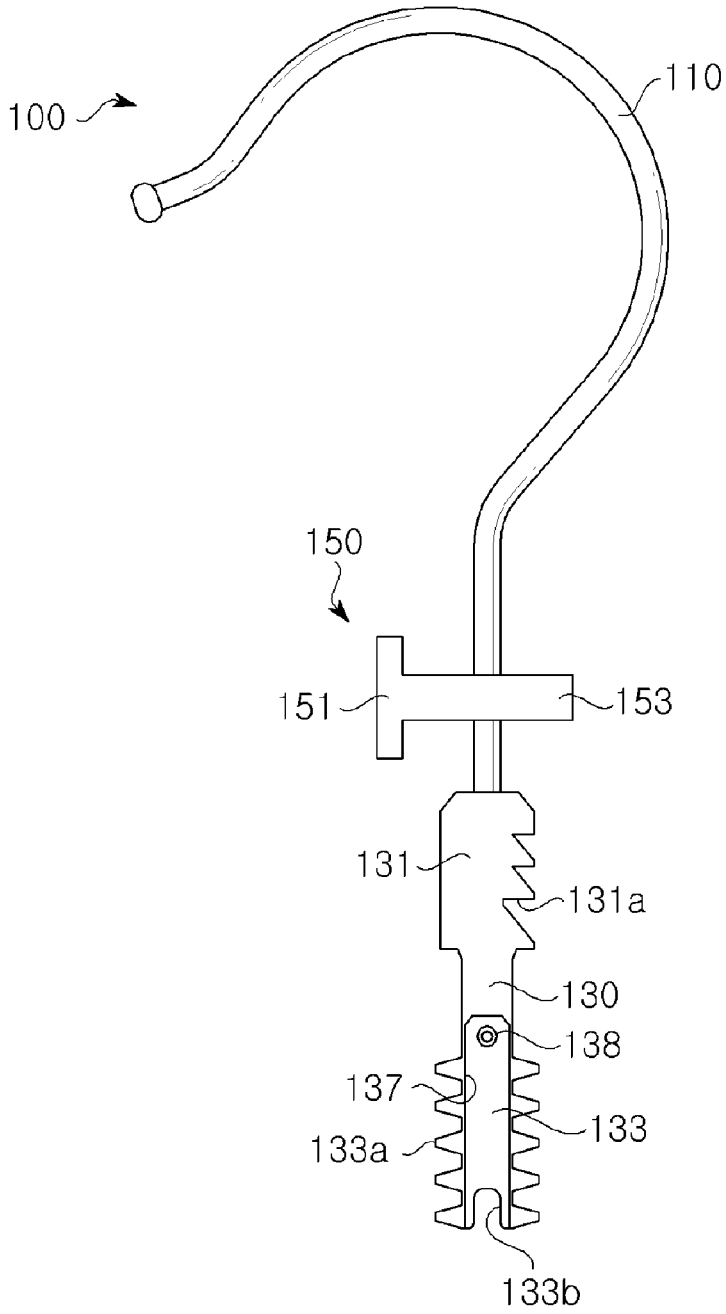
FIG. 4 is a plan view illustrating the construction of a hook unit of the foldable coat hanger according to the exemplary embodiment of the present invention.
Figure 5:
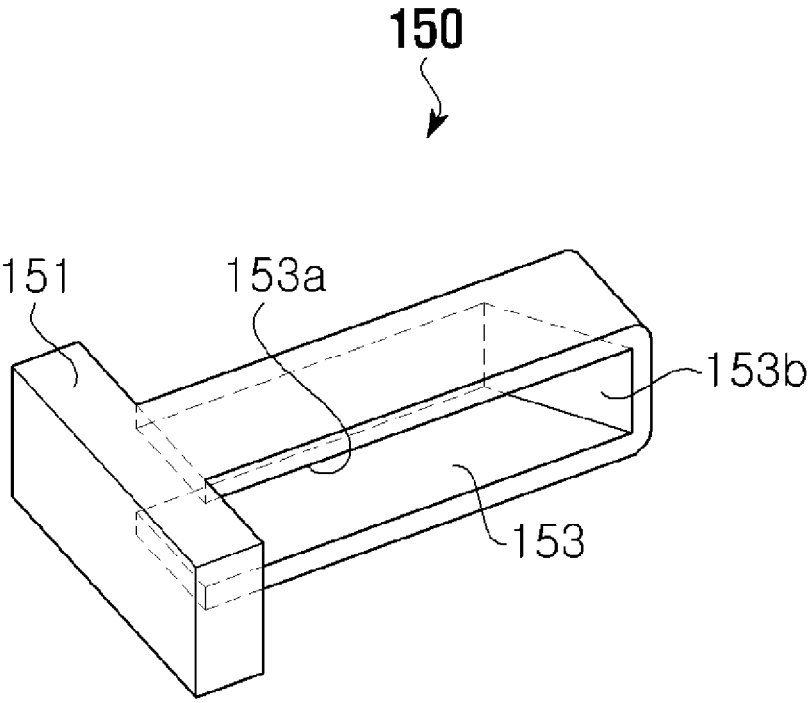
FIG. 5 is a perspective view illustrating the shape of an actuating unit included in the hook unit of the foldable coat hanger according to the exemplary embodiment of the present invention.

FIG. 1 is an exploded perspective view of a foldable coat hanger according to an exemplary embodiment of the present invention. FIG. 2 is a plan view illustrating the construction of the foldable coat hanger according to the embodiment of the present invention. FIG. 3 is an enlarged plan view illustrating the interior construction of the foldable coat hanger fabricated inside the dotted circle of FIG. 1. FIG. 4 is a plan view illustrating the construction of a hook unit of the foldable coat hanger according to the embodiment of the present invention. FIG. 5 is a perspective view illustrating the shape of an actuating unit included in the hook unit of the foldable coat hanger according to the embodiment of the present invention.

As shown in FIG. 1 through FIG. 5, the foldable coat hanger 10 according to the embodiment of the present invention includes a hook unit 100, a housing unit 200 and hanging arms 400.

In the embodiment of the present invention, the hook unit 100 is assembled with the housing unit 200 in such a way that they can move relative to each other, but cannot be disassembled from each other. In other words, a first end of the hook unit 100 is inserted into the housing unit 200 in such a way that the hook unit 100 can move upwards or downwards in vertical directions relative to the housing unit 200. Further, two hanging arms 400 are rotatably assembled with the housing unit 200 in such a way that the hanging arms 400 can rotate relative to the housing unit 200. Here, the rotating angles of the hanging arms 400 are determined by the vertical movement of the hook unit 100. That is, when the hook unit 100 is moving upwards to a raised position, the two hanging arms 400 open such that the free ends thereof become distant from each other. On the contrary, when the hook unit 100 is moving downwards to a lowered position, the two hanging arms 400 fold such that the free ends thereof become close to each other.

The hook unit 100 includes a hook 110 which hangs the coat hanger 10 on a hanging member, such as a hanging hook or a hanging rod, installed in a wardrobe, etc. The hook 110 is made of metal or plastic, and has a first end which is rounded into a hook shape suitable for being hung on a hanging member and a second end that extends straight. In other word, the upper end of the hook 110 based on the vertical direction of the coat hanger 10 is shaped to have a hook shape, while the lower end of the hook 110 extends straight. Further, the lower end of the hook 110 is provided with a toothed part 130. The toothed part 130 may be integrally formed with the hook 110 into a single structure or may be integrated with the hook 110 into a single body after being produced separately from the hook 110. In the following description, the technical terms "upward", "downward", "upper" and "lower" are designated based on a state in which the coat hanger 10 is hung on a hanging member.

The toothed part 130 axially extends in a vertical direction, with a control gear 131 formed in the upper portion of the toothed part 130 and used for controlling the relative movement between the hook unit 100 and the housing unit 200, and a rack gear 133 formed in the lower portion of the toothed part 130, the rack gear 133 being used to control the rotating motion of the hanging arms 400. The control gear 131 is formed by a plurality of teeth 131*a* which are repeatedly formed along an axial edge of a generally rectangular plate part. Each of the teeth 131*a* has an inclined edge, which is inclined relative to the axis of the control gear 131 at a predetermined angle, and a perpendicular edge, which is perpendicular to the axis of the control gear 131. The inclined edges and the perpendicular edges of the teeth 131*a* are alternately arranged along the axial edge of the control gear 131.

As shown in FIG. 4, the rack gear 133 is provided with a plurality of teeth 133*a* along each of opposite axial edges, that is, each of the left and right edges of the rack gear 133. In the rack gear 133, the numbers and shapes of the teeth 133*a* formed along the opposite axial edges are the same and are symmetric with each other. Further, the rack gear 133 is longitudinally depressed along an axial surface except for the two axial edges having the teeth 133*a*, thus forming an axial depression 137, with a first locking protrusion 138 provided in the upper end of the axial depression 137 for locking one end of a tension spring 135 which will be described later herein. The lower end of the axial depression 137 is open downwards, with a notch 133*b* cut upwards from the lower open end of the axial depression 137. The notch 133*b* allows a second locking protrusion 213 of the housing unit 200, which will be described later herein, to be located in the axial depression 137 after passing through it when the hook unit 100 is fully retracted into the housing unit 200.

Further, a tension spring 135 which elastically biases the hook unit 100 in a downward direction is located in the axial depression 137. Opposite ends 135*a* and 135*b* of the tension spring are locked to the first and second locking protrusions 138 and 213, respectively. Described in detail, the upper end 135*a* of the tension spring 135 is hooked on the first locking protrusion 138 and thereby locked to the hook unit 100, while the lower end 135*b* of the tension spring 135 is hooked on the second locking protrusion 213 and thereby locked to the housing unit 200. During vertical movement of the hook unit 100 relative to the housing unit 200 in the above state, the tension spring 135 is extended and put under tension in response to upward movement of the hook unit 100 and is compressed in response to downward movement of the hook unit 100.

Further, as shown in the drawings, a T-shaped actuating unit 150 is caught by the hook 110 of the hook unit 100. As shown in FIG. 4, the actuating unit 150 includes a manipulating knob 151, which is located in a direction parallel to the extending direction of the hook 110, and an actuating body 153 which extends in a direction perpendicular to the extending direction of the hook 110. As shown in FIG. 2, the actuating body 153 of the actuating unit 150 is housed in the housing unit 200, while the manipulating knob 151 of the actuating unit 150 is exposed outside the housing unit 200. Here, the actuating body 153 is provided with a through opening 153*a*, which is formed through the actuating body 153. The through opening 153*a* extends in an axial direction of the actuating body 153 within a range including the entire length of the actuating body 153. However, one end of the actuating body 153, which is opposed to the manipulating knob 151, is closed, with an inclined stop surface 153*b* being defined in the closed end of the through opening 153*a*. In the above state, the inclined stop surface 153*b* of the actuating unit 150 selectively catches the teeth 131*a* of the control gear 131, thus holding the control gear 131 in a desired position.

Here, the actuating unit 150 reciprocates in directions perpendicular to the moving directions of the hook unit 100. One end of the actuating body 153, which is opposed to the manipulating knob 151, comes into contact with a compression spring 155 which will be described later herein. Further, to allow the actuating unit 150 to reciprocate in axial directions of the actuating body 153, the manipulating knob 151 protrudes outside the housing unit 200, thus being biased in a direction toward the interior of the housing unit 200 (in a rightward direction of FIG. 2), and the compression spring 155 elastically biases the manipulating unit 150 in an outward direction from the housing unit 200 (in a leftward direction of FIG. 2).

As described above, the actuating unit 150 can reciprocate in directions perpendicular to the moving direction of the hook unit 100, so that, when no external force is applied to the manipulating knob 151, the actuating unit 150 is elastically biased by the compression spring 155 and the stop surface 153*b* of the actuating body 153 is brought into engagement with one of the teeth 131*a* of the control gear 131 and stops the hook unit 100 at a determined location. However, when an external force acts on the manipulating knob 151 and thereby the actuating unit 150 is pushed toward the interior of the housing unit 200, the stop surface 153*b* is released from the teeth 131*a* and allows the hook unit 100 to be movable. Here, the teeth 131*a* may comprise a plurality of teeth which can stepwisely stop the hook unit 100 at a plurality of locations. For example, the hook unit 100 may comprise four teeth 131*a* so that the hook unit 100 can be controllably stopped at one of four locations.

Further, the housing unit 200 cooperates with a housing cover 200' and defines therebetween an elliptical chamber having a predetermined height. As shown in FIG. 2, the housing unit 200 includes a neck 250, which defines therein a moving chamber 255 within which both the lower end of the hook 110 and the toothed part 130 can move, and an elliptical housing body 210, which is integrated with the neck 250 into a single structure and defines therein an elliptical chamber communicating with the moving chamber 255. Here, the neck 250 extends from the housing body 210 in a direction of the minor axis of the elliptical housing body 210. Further, the housing cover 200' has a shape corresponding to that of the housing unit 200 so as to completely cover the open sides of both the housing body 210 and the neck 250.

A part of the hook unit 100 is received in the neck 250. In the neck 250, the moving chamber 255 communicating with the elliptical chamber of the housing body 210 is defined in a direction parallel to the moving direction of the hook unit 100. Both the lower end of the hook 110 and the toothed part 130 are received in the moving chamber 255. In the upper end of the moving chamber 255, to prevent the toothed part 130 from being undesirably removed from the moving chamber 255, a stopper 257 having a vertical hole allowing the hook 110 to extend outwards from and retract into the moving chamber 255 is provided. In other words, the stopper 257 includes a stop depression which has a cross-section larger than that of the hook 110 and smaller than that of the upper end of the control gear 131 so that, when the hook 110 extends outwards from the moving chamber 255, the upper end of the control gear 131 is caught by the stopper 257, thus being stopped.

Further, a depressed seat 251 is formed in the outer surface of the sidewall of the neck 250 at a predetermined position in such a way that the seat 251 communicates with the interior of the neck 250. The actuating unit 150 is inserted into the lower part of the hook 110 in a radial direction, in which the manipulating knob 151 of the actuating unit 150 can be seated in the depressed seat 251 of the neck 250 and the actuating body 153 is located inside the neck 250. In the above state, the actuating body 153 located inside the neck 250 extends in a direction parallel to the depressed direction of the seat 251. Further, the depressed shape of the seat 251 formed in the outer surface of the sidewall of the neck 250 corresponds to the shape of the manipulating knob 151 so that, when the actuating unit 150 is pushed into the neck 250 by an external force, the manipulating knob 151 of the actuating unit 150 can be seated in the seat 251. Further, a spring seat 253 is formed in the inner surface of the sidewall of the neck 250 at a location diametrically opposite to the location of the seat 251 so that the spring seat 253 can face the distal end of the actuating body 153. The compression spring 155 is seated in the spring seat 253, in which a first end of the spring 155 is fixed in the seat 253 and a second end of the spring 155 opposed to the fixed end comes into close contact with the distal end of the actuating body 153. Here, the compression spring 155 is arranged in such a way that the compression spring 155 can be compressed in a direction parallel to the axis of the actuating body 153. Therefore, when the actuating unit 150 is pushed into the neck 250, the compression spring 155 elastically biases the actuating unit 150 outwards.

The rack gear 133 is placed inside the elliptical camber defined in the housing body 210. Here, the rack gear 133 is arranged in a direction parallel to the minor axis of the elliptical chamber of the housing body 210. When the actuating unit 150 is pushed into the neck 250 and the control gear 131 moves in a vertical direction in a state in which the control gear 131 is released from the actuating unit 150, the rack gear 133 can move in the vertical direction inside the housing body 210. In the above state, when the uppermost tooth of the plurality of teeth 131*a* formed in the control gear 131 is caught by the actuating unit 150, that is, when the toothed part 130 is fully moved from the neck 250 into the housing body 210, the second locking protrusion 213 provided in the housing body 210 is aligned with the lower end of the rack gear 133. As described above, the second locking protrusion 213 of the housing unit 200 is located in the axial depression 137 of the rack gear 133 after passing through the notch 133*b* formed in the lower end of the rack gear 133, and the lower end 135*b* of the tension spring 135 is locked to the second locking protrusion 213. Therefore, when the hook unit 100 moves upwards in the vertical direction relative to the housing unit 200, the tension spring 135 is put under tension. On the contrary, when the hook unit 100 moves downwards in the vertical direction relative to the housing unit 200, the tension spring 135 elastically returns to the original state thereof. Therefore, the elastic restoring force of the tension spring 135 generated when the hook unit 100 has moved upwards elastically biases the hook unit 100 downwards, so that the hook unit 100 can be elastically retracted into the housing unit 200. In other words, when the control gear 131 is not engaged to the actuating unit 150, the hook unit 100 is pulled down by the elastic restoring force of the tension spring 135.

Further, the plurality of teeth 133*a* formed along the opposite edges of the rack gear 133 engage with respective first pinion gears 300. To install the two first pinion gears 300 in the housing body 200 at respective locations, two gear shafts 214 perpendicularly protrude from the inner surface of the housing body 210 toward the housing cover 200' and the two first pinion gears 300 are rotatably fitted over the respective gear shafts 214. Here, the two gear shafts 214 are symmetrically arranged outside the toothed opposite edges of the rack gear 133. Each of the first pinion gears 300 is provided with a plurality of teeth 300*a*, which are formed around the circumferential edge of the first pinion gear 300 and engage with the teeth 133*a* of the rack gear 133. The two first pinion gears 300 have the same shape. Therefore, when the rack gear 133 moves upwards, the two first pinion gears 300 are rotated in respective directions, in which the teeth of the gears 300 engaging with the rack gear 133 are rotated upwards and the teeth opposed to the engaging teeth are rotated downwards. On the contrary, when the rack gear 133 moves downwards, the teeth of the two first pinion gears 300 engaging with the rack gear 133 are rotated downwards and the teeth opposed to the engaging teeth are rotated upwards.

As described above, the two hanging arms 400 are rotatably assembled with the housing unit 200 at opposite locations on the major axis of the elliptical housing body 210, that is, in the left and right ends of the housing body 210 of the drawings. Further, the two hanging arms 400 extend in opposite directions away from the housing unit 200 and have a specific bent shape. A depression 410 may be formed in each of the hanging arms 400 at a predetermined position. The depressions 410 of the hanging arms 400 can stably hold a garment, thereby preventing the garment from slipping down from the coat hanger when hanging the garment on the hanger.

Here, to rotatably hold the two hanging arms 400 in the housing body 210, two bearing shafts 215 perpendicularly protrude from the inner surface of the housing body 210 in directions toward the housing cover 200' at symmetrically opposite locations based on the rack gear 133. The hanging arms 400 are rotatably fitted over the respective bearing shafts 215. To realize the assembly of the hanging arms 400 and the bearing shafts 215, the first ends of the two hanging arms 400 are provided with respective bearing holes 420, which have a diameter corresponding to that of the bearing shafts 215 and are rotatably fitted over the respective bearing shafts 215. The first ends of the two hanging arms 400 having the respective bearing holes 420 are shaped in the form of rounded and holed ends defining the respective bearing holes 420 therein, so that the hanging arms 400 can be easily rotated in the housing body 210 without interfering with other elements. Second pinion gears 430, each having a plurality of teeth, are partially formed around the rounded edges of the first ends of the two hanging arms 400 and engage with the respective first pinion gears 300. The second pinion gears 430 of the two hanging arms 400 are configured in such a way that they can engage with the respective first pinion gears 300 within predetermined rotating angles of the two hanging arms 400 relative to the housing unit 200. In the embodiment of the present invention, when each of the hanging arms 400 are configured to be rotatable within an angular range of a maximum angle of 80 degrees, the teeth of each second pinion gear 430 are formed around a part of the circumferential edge of the first end of an associated hanging arm 400 within an angular range of at least 80 degrees around the bearing hole 420. Therefore, when the two first pinion gears 300 are rotated in opposite directions in response to vertical movement of the rack gear 133, the two second pinion gears 430 of the two hanging arms 400 are rotated at the same time in the same directions as those of the respective first pinion gears 300.

Figure 6A:
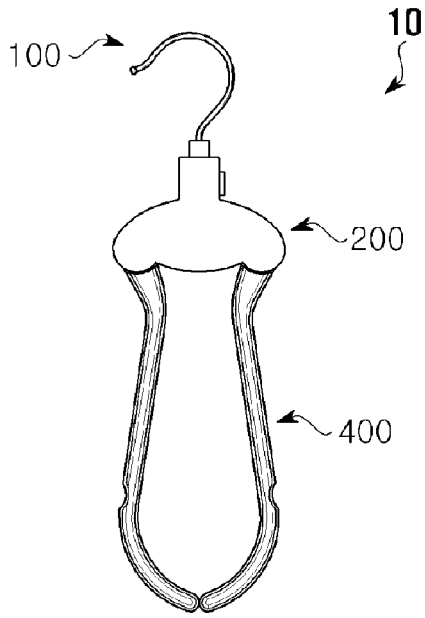
FIGS. 6A through 6D are views illustrating the operation of the foldable coat hanger according to the exemplary embodiment of the present invention.

Hereinbelow, the stepwise folding and unfolding motion of the coat hanger 10 will be described. FIGS. 6A through 6D are views illustrating the operation of the foldable coat hanger according to the embodiment of the present invention. As shown in FIG. 6A, when the coat hanger 10 is not in use, the actuating unit 150 may be actuated by a user such that the control gear 131 can be released from the actuating unit 150 and the actuating unit 150 can be caught by the uppermost tooth 131*a* of the control gear 131 by the elastic restoring force of the tension spring 135. In the above state, the hook unit 100 can be stopped at the fully retracted position inside the housing body 210. Further, because the rack gear 133 in the above state is moved to the lowermost position inside the housing body 210, the first pinion gears 300 and the second pinion gears 430 are rotated at the same time in response to the linear movement of the rack gear 133, so that the hanging arms 400 are rotated in opposite directions in such a way that the outside ends of the hanging arms 400 are put close to each other. Therefore, the two hanging arms 400 can realize a fully folded state in which the hanging arms 400 are arranged in a downward parallel arrangement.

Figure 6B:
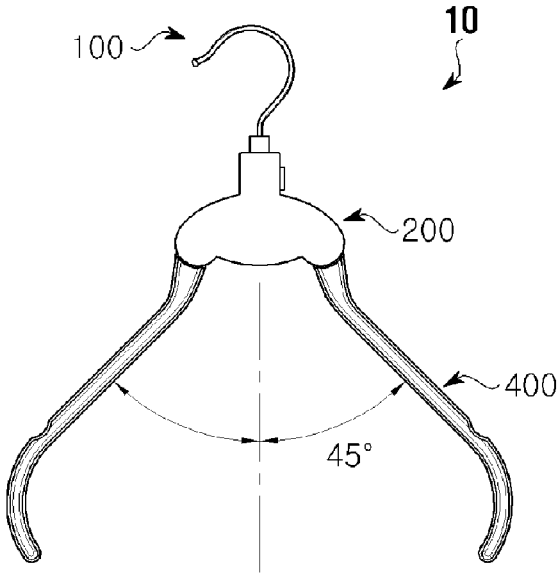
Figure 6C:
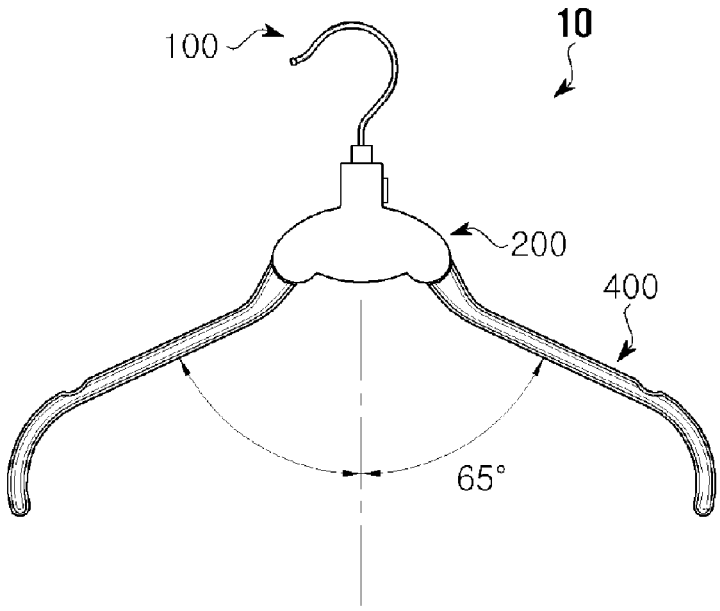
Figure 6D:
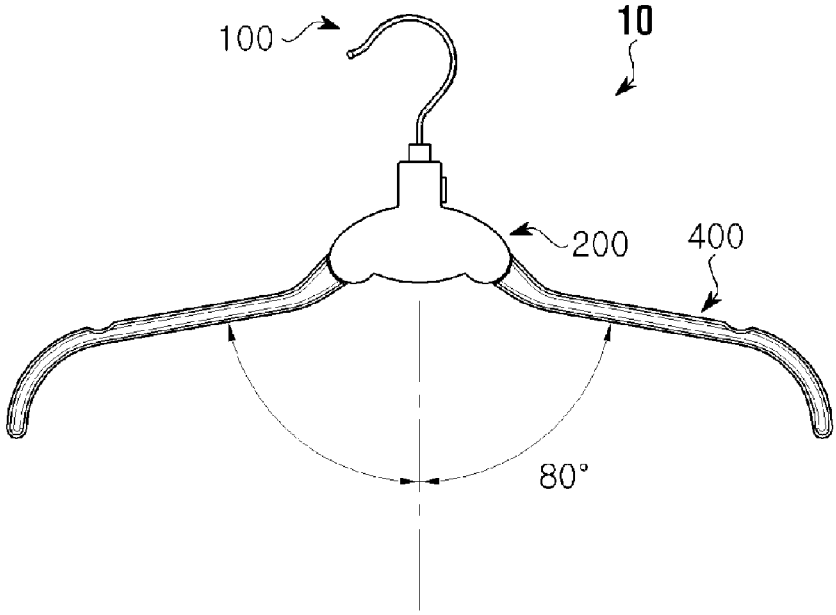

Further, when the two hanging arms 400 are stepwisely rotated outwards, the actuating unit 150 is stepwisely shifted from the uppermost tooth 131*a* of the control gear 131 to lower teeth 131*a* one by one, so that the hanging arms 400 can be stepwisely opened as shown in FIGS. 6B, 6C and 6D. When the actuating unit 150 is caught by the lowermost tooth 131*a* of the control gear 131, the two hanging arms 400 can be fully opened to a maximum angle of 160 degrees.

Here, to adjust the engaging position of the actuating unit 150 relative to the control gear 131, a user can grip the hanging arms 400 with a hand and can easily widen the space between the hanging arms 400 to a desired position. In addition, to fold the hanging arms 400 and simultaneously to put the hook 110 into the housing unit 200, a user has only to push the manipulating knob 151 of the actuating unit 150 toward the housing unit 200.

As described above, the foldable coat hanger according to the embodiment of the present invention is advantageous in that, when the hanger is not in use, the two hanging arms of the coat hanger can be folded into a fully folded position and the hook can be fully retracted into the housing body, thus realizing a reduction in the volume of the coat hanger. Another advantage of the foldable coat hanger of the present invention resides in that, when the hanger is used to hang a garment, the size of the coat hanger can be stepwisely adjusted between a plurality of size stages according to the size of the garment, so that the garment can be efficiently hung and protected.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, the present invention is not limited thereto, and it will be understood by those of ordinary skill in the art that various modifications and changes in form and details may be made therein without departing from the spirit or scope of the present invention as defined by the following claims.

What is claimed is:

1. A foldable coat hanger, comprising:

a hook unit having a hook in an upper part thereof; a housing unit with which the hook unit is assembled such that the hook unit can be moved upwards or downwards vertically; and a pair of hanging arms rotatably assembled with opposite sides of the housing unit, wherein the hook unit comprises:

a control gear connected to a lower end of the hook and extending in an axial direction, with a plurality of teeth formed along a side edge of the control gear in the axial direction;

a rack gear connected to a lower end of the control gear and extending in the axial direction, with a plurality of teeth formed along each of opposite side edges of the rack gear in the axial directions; and an actuating unit removably caught by one of the teeth of the control gear and stopping a position of the control gear, the housing unit comprises:

two first pinion gears symmetrically provided in the housing unit at locations in opposite sides of the rack gear and rotatably engaging with the teeth formed along the opposite side edges of the rack gear, and the two hanging arms are rotatably fitted over respective bearing shafts provided at opposite locations inside the housing unit and extend outwards from the housing unit while being bent toward each other, with second pinion gears formed around respective ends of the two hanging arms fitted over the bearing shafts and rotatably engaging with the respective first pinion gears.

2. The foldable coat hanger as set forth in claim 1, further comprising:

a tension spring locked at opposite ends thereof to an end of the rack gear and to a lower part of an interior of the housing unit and providing an elastic restoring force to the hook unit that elastically biases the hook unit downwards.

3. The foldable coat hanger as set forth in claim 1, further comprising:

a compression spring coming into contact with a first end of the actuating unit and providing an elastic restoring force to the actuating unit for elastically biasing the actuating unit outwards from the housing unit, wherein the actuating unit comprises:

an inclined stop surface provided in the first end of the actuating unit that is in contact with the compression spring and caught by one of the teeth of the control gear when the actuating unit is elastically moved outwards from the housing unit by the restoring force of the compression spring; and a manipulating knob provided in a second end of the actuating unit in such a way that the manipulation knob is exposed outside the housing unit so as to be manipulated in order to move the housing unit in an inward direction.

4. The foldable coat hanger as set forth in claim 1, wherein the hanging arms are rotated in opposite directions to fold and unfold in response to movement of the hook unit in such a way that, when the hook unit and the rack gear are moving downwards, the free ends of the hanging arms can be rotated to be put close to each other by the rotational engagement of the first and second pinion gears and, when the hook unit and the rack gear are moving upwards, the free ends of the hanging arms can be rotated to be made distal to each other by the rotational engagement of the first and second pinion gears.

5. The foldable coat hanger as set forth in claim 1, wherein, when the actuating unit is caught by an uppermost one of the teeth of the control gear, the two hanging arms have been rotated to be folded in a downward parallel arrangement, and when the actuating unit is caught by a lowermost one of the teeth of the control gear, the two hanging arms have been rotated to be opened at an angle of at least 150 degrees.

* * * * *